United States Patent [19]

Shimamura et al.

[11] 3,984,243

[45] Oct. 5, 1976

[54] PHOTOGRAPHIC DEVELOPER COMPOSITIONS FOR OBTAINING HIGH CONTRAST IMAGES

[75] Inventors: Isao Shimamura; Yoo Iijima; Katsumi Hayashi; Haruhiko Iwano; Tadao Shishido, all of Minami-ashigara, Japan

[73] Assignee: Fuji Photo Film Co., Ltd., Minami-ashigara, Japan

[22] Filed: Dec. 21, 1973

[21] Appl. No.: 427,171

[30] Foreign Application Priority Data

Dec. 21, 1972 Japan ..... 47-128607

[52] U.S. Cl. ..... 96/66.3

[51] Int. Cl.[2] ..... G03C 5/30

[58] Field of Search ..... 96/66 R, 66.3, 66.4, 96/66.5

[56] References Cited

UNITED STATES PATENTS

| | | | |
|---|---|---|---|
| 3,615,488 | 10/1971 | Drago et al. | 96/66 R |
| 3,615,524 | 10/1971 | Milton | 96/66.3 |
| 3,708,303 | 1/1973 | Salesin | 96/66 R |
| 3,713,827 | 1/1973 | Willems | 96/66.3 |
| 3,749,574 | 7/1973 | Pollet et al. | 96/66 R |
| 3,847,618 | 11/1974 | Hofman et al. | 96/66 R |

OTHER PUBLICATIONS

T896,022, Mar. 1972, Williams et al., 96/66.3.

*Primary Examiner*—Mary F. Kelley

*Attorney, Agent, or Firm*—Sughrue, Rothwell, Mion, Zinn and Macpeak

[57] ABSTRACT

A photographic developer composition for obtaining high contrast images which comprises (1) a dihydroxybenzene developing agent, (2) an alkanolamine and (3) a compound having the following formula (I)

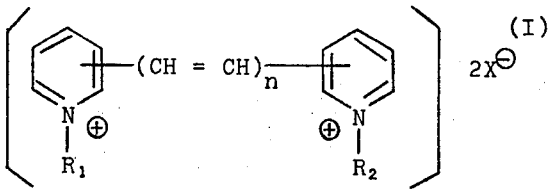

(I)

wherein $R_1$ and $R_2$ each represents a lower aliphatic hydrocarbon group, wherein $R_1$ and $R_2$ may combine to form a ring, *n* represents 0 or 1, and $X^{\ominus}$ represents an anion.

20 Claims, No Drawings

PHOTOGRAPHIC DEVELOPER COMPOSITIONS FOR OBTAINING HIGH CONTRAST IMAGES

BACKGROUND OF THE INVENTION

1. Field of the Invention

The present invention relates to photographic developer compositions for obtaining high contrast images. More particularly, the present invention relates to photographic developers having an accelerated developing speed.

2. Description of the Prior Art

Usually, high contrast photographic sensitive materials are used in the graphic arts fields in order to photographically produce line images and halftone images. For example, line images can be formed by exposing a litho-type photographic sensitive material to an original having a continuous gradation through a screen and developing using a so-called infectious developer (*Photographic Processing Chemistry*, pages 163 – 165, (1966) written by Mason, published by Focal Press Library).

Since this developer has a low initial developing speed, increasing the developing speed is an obstacle. Particularly, the initial developing speed of this developer is decreased markedly if an improvement in a substantial defect of the developer (namely, low storage stability) is attempted. For example, it is known to add amines to the developer as a means for improving the storage stability (as disclosed in British Pat. Specification No. 1,192,075), but, the quality of the halftone image is further deteriorated and the initial developing speed is further decreased.

On the other hand, the addition of many kinds of development accelerators to silver halide emulsion layers has been suggested in order to increase the developing speed (as disclosed in British Pat. No. 1,098,748 and U.S. Pat. No. 3,518,085). However, it is difficult to obtain excellent halftone images. Further, if these development accelerators are added to the developer, the quality of the halftone image deteriorates because infectious development is destroyed or at least severely reduced.

As described above, prior developers for obtaining high contrast images can not provide both increased initial developing speed and excellent halftone image quality.

Accordingly, an object of the present invention is to increase the initial developing speed, that is, to provide developers which have high sensitivity in a short developing period.

A second object of the present invention is to provide developers which form halftone images having excellent quality.

A third object of the present invention is to provide developers having excellent storage stability.

SUMMARY OF THE INVENTION

As the result of much research on attaining the above described objects, the present inventors have found these and other objects of the invention can be achieved with a high contrast developer containing (1) a dihydroxybenzene type developing agent, (2) an alkanol amine and (3) a compound represented by the following formula (I)

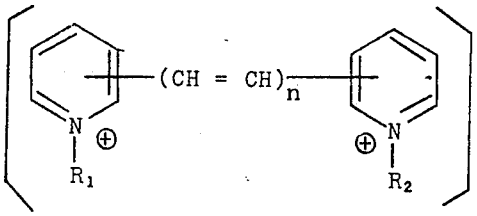

(I)

(wherein $R_1$ and $R_2$ each represents a lower aliphatic hydrocarbon group (with $R_1$ and $R_2$ also being able to form a ring by linking together), $n$ represents 0 or 1, and X represents an anion).

DETAILED DESCRIPTION OF THE INVENTION

Suitable lower aliphatic hydrocarbon groups for $R_1$ and $R_2$ in the above described formula (I) are preferably alkyl groups, and more preferably alkyl groups having 1 to 5 carbon atoms.

Where $R_1$ and $R_2$ form a fused ring with the two nitrogen atoms, the ring formed is an unsaturated or saturated 6 to 8-membered ring to which an aromatic ring such as a benzene ring can be further fused.

Suitable anions for X include a halogen ion, p-toluene sulfonate, a nitrate, a hydrochloride, sulfate, etc.

The dihydroxybenzenes which is used as the developing agent are compounds which have two hydroxyl groups in the benzene ring and are substituted or unsubstituted by other substituents and which have the function of reducing silver halides. These developing agents are well known in the photographic field and can be selected easily and suitably by persons skilled in the art. In particular, hydroquinones are commonly used. Examples of hydroquinones include hydroquinone, chlorohydroquinone, bromohydroquinone, isopropylhydroquinone, toluhydroquinone, methylhydroquinone, 2,3-dichlorohydroquinone and 2,5-dimethylhydroquinone. Of these compounds, hydroquinone is most practically used. These developing agents can be used alone or as a mixture of two or more thereof. They generally are used in an amount of from about 5 to 50g per liter of the developer and preferably from 10 to 30g per liter of the developer.

The alkanolamines as the second component can also be used alone or as mixtures thereof. Suitable alkanolamines which can be employed have the general formula

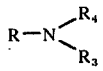

wherein R is a hydroxyalkyl group having 1 to 5 carbon atoms, and $R_3$ and $R_4$ are each hydrogen, an alkyl group having 1 to 4 carbon atoms or a hydroxyalkyl group having 1 to 3 carbon atoms. The alkanolamines used in the developer concentrates of the invention typically serve both as a solvent and as a development activator. One or more of the suitable alkanolamines is typically in liquid form. Alkanolamines within the scope of the invention include: 2-aminoethanol, 2-methylaminoethanol, 2-ethylaminoethanol, 2-n-propylaminoethanol, 2-dimethylaminoethanol, 2-diethylaminoethanol, diethanolamine (2,2'-iminodiethanol), 2-aminopropanol, 3-aminopropanol, 3-diethylamino-1-propanol, 1-dimethylamino-2-propanol, 3-dimethylamino-1,2-propane diol, 4-aminobutanol, 4-diethanolaminobutanol, 5-aminopentanol, 5-diethanolamino-2-pentanol, 2-isopropylaminoethanol, 2-amino-α-methyl-1-propanol, triethanolamine, 5-diethanolaminopentanol, methylolamine, trimethylolamine, 2-(di-n-propyl)aminoethanol, 3-methylaminopropanol, 2-methylolaminoethanol. Preferred alkanolamines include secondary amines such as diethanolamine and diisopropanolamine and tertiary amines such as triethanolamine and triisopropanolamine. Of these alkanolamines, diethanolamine and triethanolamine are preferably used because they provide good effects in combination. The alkanolamines are generally used in an amount from about 5 to 400g per liter of the developer and preferably 10 to 150g.

The compounds represented by the above described formula (I) as the third component are bipyridinium salts or are the so-called Weitz radical. It should be noted these compounds render obsolete the prior idea that quaternary compounds destroy infectious development.

In the above described formula, suitable examples of $R_1$ and $R_2$ are alkyl groups and particularly lower alkyl groups having 1 to 5 carbon atoms. $R_1$ and $R_2$ can combine together as alkylene groups or vinylene groups forming condensed rings (wherein the condensed ring may form another condensed ring). Of course, the above described formula is not limited to only these specifically exemplified substituents. The compound represented by the above formula can be used alone or as mixture of two or more thereof. They are generally used in an amount of $1 \times 10^{-5}$ to $1 \times 10^{-2}$ moles per liter of the developer and particularly $1 \times 10^{-4}$ to $1 \times 10^{-3}$ moles. Specific examples of these compounds are as follows.

Compound 1

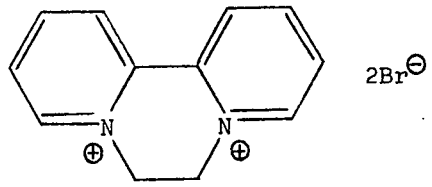

Compound 2

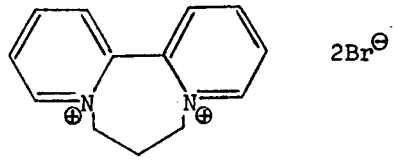

Compound 3

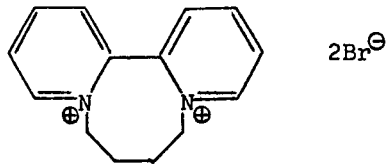

Compound 4

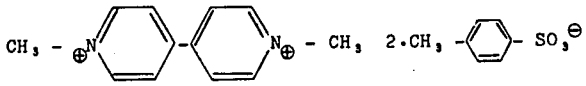

Compound 5

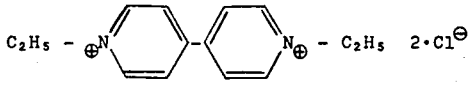

Compound 6

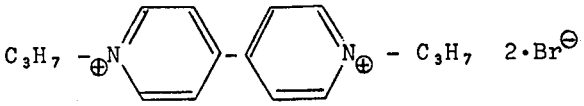

Compound 7

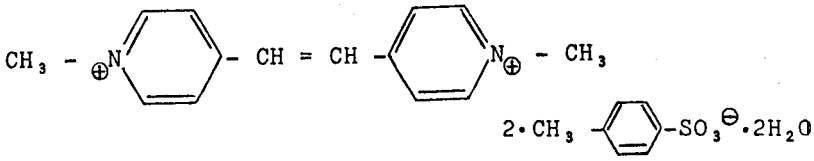

Compound 8

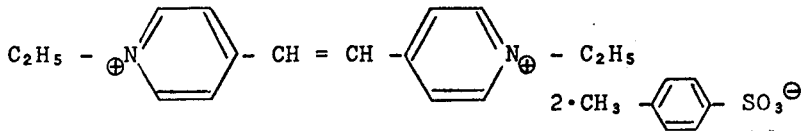

Compound 9

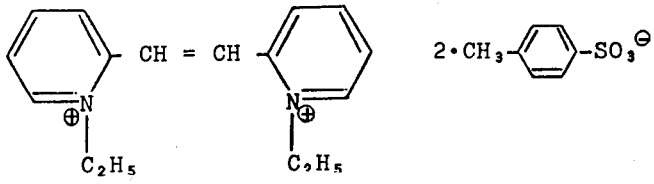

Compound 10

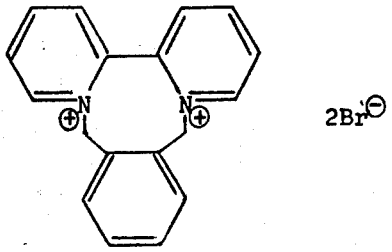

Compound 11

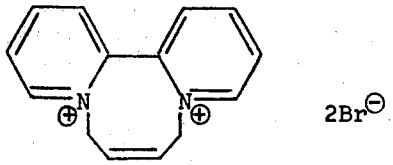

Compound 12

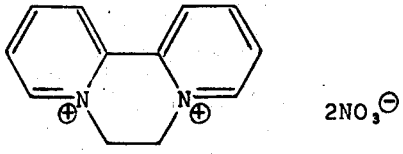

Compounds 1 to 9 and 11 are all known compounds, which are described in Tetrahedron, 24 2697 (1968), ibid., 24 5433 (1968) and ibid., 24 6543 (1968), *J. Heterocyclic Chem.*, 7 719 (1970), ibid., 7 401 (1970) and ibid., 8 29 (1971), and *J. Chem. Soc.*, (C), 1643 (1969) by L. A. Summer. Compound 12 is described in *J. Chem. Soc.*, 5816 (1965).

Suitable processes for preparing these compounds are explained in the following.

SYNTHESIS 1 (Compound 10)

7g of $\alpha,\alpha'$-dipyridyl and 25g of o-xylene bromide were added to 50ml of dimethylformamide. The mixture was refluxed by heating on an oil bath for 3 hours. After cooling, the resulting crystals were filtered and recrystallized from ethanol. Thus 14g of needle-like crystals having a melting point above 350° C was obtained.

| | Elementary Analysis: ($C_{18}H_{16}N_2Br_2$) Measured | Calculated |
|---|---|---|
| C = | 51.38% | 51.43% |
| H = | 3.87% | 3.81% |
| N = | 6.95% | 6.67% |

SYNTHESIS 2 (Compound 12)

8g of Compound 1 was dissolved in 100ml of water and the mixture was stirred at room temperature. Then, a solution prepared by dissolving 7g of silver nitrate in 100ml of water was added dropwise to the above solution. After addition, the silver bromide formed was removed by filtration and the mother liquor was condensed under reduced pressure. The resulting crystals were recrystallized from ethanol, by which 4g of colorless needle-like crystals having a decomposition point of 215° C was obtained.

| | Elementary Analysis: ($C_{12}H_{12}N_4O_6$) Measured | Calculated |
|---|---|---|
| C = | 46.54% | 46.76% |
| H = | 3.90% | 3.92% |
| N = | 17.90% | 18.18% |

Among the above described compounds, Compounds 1 to 3 are particularly preferred.

It is possible to add common developer ingredients used for obtaining high contrast images to the developer compositions of the present invention in addition to the above three components.

For example, litho-type developers usually have a low free sulfite ion concentration, and contain below 5g and usually below 3g of alkali metal sulfite salts. The litho-type developers further contain a sulfite ion buffer in the amount sufficient to keep a low sulfite ion concentration (0.1 to 1.0 mol and preferably 0.25 to 0.5 mols per liter of the developer).

Examples of sulfite ion buffers include aldehydealkali metal hydrogen sulfite addition products such as formaldehyde-hydrogen sulfite addition product, ketone-alkali metal hydrogen sulfite addition products such as acetone-sodium hydrogen sulfite addition product and carbonyl-amine hydrogen sulfite condensates such as sodium bis-(2-hydroxyethyl)aminomethane sulfonate. The amount of the sulfite ion buffer which can be used in 13 to 130g, preferably 30 to 80g, per 1 liter of developer. The litho-type developers further contain alkali substances. The alkali substances are added to make the pH of the developer above 8, preferably 9 or more and most preferably in the range of 9.7 to 11.5. Accordingly the amount and kind of alkali agent which can be used is not limited.

In addition to the alkali agents, pH buffers can be added. Examples of the alkali agents and the pH buffer agents include water soluble acids (e.g., acetic acid, boric acid and phosphoric acid), alkalis (e.g., sodium hydroxide) and salts (e.g., sodium carbonate), or a development controlling agent such as an alkali halide. Some kinds of alkaline agents act not only to make the developer alkaline but also as a pH buffer or a development controlling agent. The kind and quantity of these compounds can be decided freely, because they are used to make the pH of the developer higher than 7 and particularly above 8. Furthermore, the developers can contain antioxidants (e.g., kojic acid and ascorbic acid), antifogging agents (e.g., halides such as potassium bromide and sodium bromide, and organic antifogging agents such as nitrogen containing heterocyclic compounds such as benzotriazole, 1-phenyl-5-mercaptotetrazole, etc.), organic solvents (e.g., triethyleneglycol, diethyleneglycol, dimethylformamide and cellosolve), and water softeners (e.g., aminopolycarboxylic acids such as nitrilotriacetic acid and ethylenediaminetetraacetic acid, or salts thereof, and phosphoric acid salts such as sodium tripolyphosphate and sodium tetrapolyphosphate).

Each of the components can be added to the developer at the time of use. It is also possible for the developer composition to be in the form of two or more parts and mixed up on use. Accordingly, any type of developer (e.g., supplying solution, etc.) is included in this invention so long as the developer contains the above components.

The high contrast photographic sensitive materials which can be treated with the developers of the present invention comprise silver halide emulsion as disclosed in U.S. Pat. Nos. 2,656,271; 2,271,291; 3,000,736; 2,496,940; and 2,497,917. The silver halides of the emulsions include silver chloride, silver bromochloride and silver iodobromochloride. In particular, silver halide compositions containing above 50 mol% and preferably above 70 mol% of silver chloride are preferably used so as to attain the objects of the present invention effectively.

The silver halide emulsions can contain as a dispersing agent one or more hydrophilic colloid substances, for example, gelatin and acylated gelatin derivatives such as phthalated gelatin and malonated gelatin, cellulose derivatives such as hydroxyethylcellulose and carboxymethylcellulose, soluble starches such as dextrin and alkali starch, and hydrophilic high molecular weight polymers such as polyvinyl alcohol, polyvinyl pyrrolidone, polyacrylamide and polystyrene sulfonic acid, etc.

The silver halide emulsions can contain water insoluble high molecular weight polymers such as polyalkyl acrylates, polymethacrylates, polyacrylic acids and interpolymers of alkylacrylate and acrylic acid, or can contain plasticizers such as glycerine and trimethanolpropane.

The emulsions which can be used for producing these sensitive materials can be sensitized in any manner at preparation thereof or at application thereof. For example, they can be chemically sensitized using well known methods such as by using sodium thiosulfate, alkyl thiourea, and/or gold compounds such as a complex salt of monovalent gold and thiocyanic acid or using a mixture of these compounds. Further, the emulsions can contain heavy metal compounds such as compounds of platinum, palladium, iridium, rhodium and cadmium. The emulsions can be ortho- or panchromatically sensitized by adding color sensitizers such as the cyanine dyes and the merocyanine dyes. Further, the emulsions can contain line and halftone improving agents such as polyalkylene oxides and amine compounds (as described in U.S. Pat. Nos. 3,288,612, 3,615,527 and 3,345,175) and sodium benzenethiosulfate, benzotriazole and 1,3,3*a*,7-tetrazaindene derivatives (as described in U.S. Pat. Nos. 3,190,752, 3,375,114 and 3,333,959). Furthermore, the emulsions can be hardened using hardeners such as formaldehyde, dimethylolurea, 2,4-dichloro-6-hydroxy-1,3,5-triazine (as described in U.S. Pat. No. 3,325,287) and mucochloric acid, or can contain surface active agents such as saponin as a coating acid. The emulsions can contain development improving agents such as 3-pyrazolidone derivatives and pyrazolone derivatives. Moreover, the emulsions can contain development accelerators such as quaternary ammonium salts and cationic surface active agents. The support of the photosensitive materials which can be used in the present invention is not limited. Thus, glass, cellulose acetate, polystyrene, polycarbonate and polyethylene terephthalate films can be used as the support.

In the developer compositions of the present invention, all defects in high contrast developer compositions are remarkably improved by combining the above described three components. When the developer compositions of the present invention are used, the period in which infectious development (that is, the development induction period) occurs is shortened markedly and rapid infectious development results thereby. Consequently the period of development can be shortened to a great extent. This technique makes possible the rapid development of high contrast photosensitive materials. Moreover, high contrast developers prepared using the developer compositions of the present invention have excellent stability and undergo oxidation by air with difficulty. Therefore, photographic images having stable photographic quality can be obtained at any time without supplying new developer composition or developer composition components. Furthermore, the photographic images obtained using the developer compositions of the present invention have a very high edge gradient and, consequently, line images and halftones images having high contrast and good quality can be obtained. In addition, since dots have no intermediate density area (the so-called "fringe"), small dots having an area ratio of below 20% keep their shape and dots having an area ratio of above 80% do not collapse (white parts of the halftone dots are blackened by the fringe). Accordingly, the exposure range reproduced by halftone dots is enlarged, whereby the formed images are rich in gradation. Further, if the development is carried out using the developer compositions of the present invention, the developing period is shortened, and the edge gradient is not reduced even if the developing period is prolonged. Consequently excellent halftone images can be obtained. Thus, the tolerance of the developing period is enlarged and development results in less variation. Accordingly, the developer compositions of the present invention are effectively used in the graphic arts fields.

The invention will now be explained in greater detail by reference to the following non-limiting examples of the present invention. Unless otherwise indicated, all parts, percents, ratios and the like are by weight.

EXAMPLE 1

A silver halide emulsion of 75% by mol of silver chloride, 0.2% by mol of silver iodide and balance of silver bromide was subjected to gold sensitization using $KAuCl_3$ and sulfur sensitization using sodium thiosulfate. Then it was optically sensitized using 3-carboxymethyl-5-(2-(3-ethylthiazolinylidene) rhodamine. Further, polyoxyethylene nonylphenyl ether containing 50 ethylene oxide units per molecule and a compound having the formula

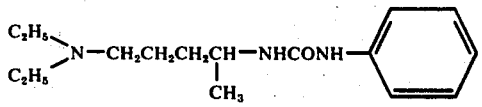

were added. Then mucobromic acid and polybutyl methacrylate were added thereto to prepare a coating solution. This coating solution was applied to polyethylene terephthalate supports and dried to produce photographic films. After exposing these photographic films to an exposure wedge for sensitometry through a 150 line magenta contact screen, they were developed at 27° C using following four compositions.

| | |
|---|---|
| Solution I: | |
| Distilled Water | 100 ml |
| Formaldehyde-Sodium Hydrogen Sulfite Addition Product | 32 g |
| Potassium Sulfite (monohydrate) | 3.5 g |
| Triethyleneglycol | 40 g |
| Hydroquinone | 16 g |
| Distilled water to make | 167 ml |
| Solution II: | |
| Distilled Water | 70 ml |
| Formaldehyde-Sodium Hydrogen Sulfite Addition Product | 14 g |
| Boric Acid | 2.5 g |
| Sodium Bromide | 1.0 g |
| Potassium Carbonate | 30 g |
| Distilled water to make | 167 ml |

Just before using, Solution I was added to 600ml of water and then Solution II was added thereto. Additional water was added thereto to produce 1 liter of the developer for use.

Developer B

The same procedure as described in Developer A was carried out but 100mg of Compound 3 of the present invention was added to Solution I of Developer A.

Developer C

The same procedure as described in Developer A was carried out but 80g of diethanolamine instead of 30g of potassium carbonate was used in Solution II of Developer A.

Developer D

The same procedure as described in Developer A was carried out but 100mg of Compound 3 of the present invention was added to Solution I of Developer A and 80g of diethanolamine instead of 30g of potassium carbonate was added in Solution II of Developer A.

Developer E

The same procedure as described in Developer A was carried out but 100mg of Compound 13 having the following formula (which is outside the scope of this invention) was added. Compound 13

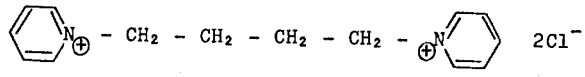

Developer F

The same procedure as described in Developer A was carried out but 100mg of Compound 13 above described was added to Solution I of Developer A and 80g of diethanolamine instead of 30g of potassium carbonate was added in Solution II of Developer A.

The pH of the Developers B to F was adjusted to the pH of Developer A.

The relative sensitivity of thus obtained samples and the quality of halftone obtained are shown in the following table. Further, the time necessary to obtain, using Developers B to F, the same sensitivity as that obtained by developing for 90 seconds using Developer A is shown in this table.

| Developer | Additive | | Development for 90 Seconds: Relative Sensitivity* | Halftone Quality** | Relative Development Time*** (second) |
|---|---|---|---|---|---|
| A | — | — | 1.00 | 9 | 90 |
| B | Compound 3 | — | 1.25 | 10 | 75 |
| C | — | Diethanolamine | 0.40 | 6 | 240 |
| D | Compound 3 | Diethanolamine | 1.05 | 10 | 85 |
| E | Compound 13 | — | 1.50 | 3 | 60 |
| F | Compound 13 | Diethanolamine | 1.10 | 3 | 85 |

*The relative sensitivity is shown as the relative value of the logarithm of the sensitivity assuming the sensitivity obtained by developing for 90 seconds with Developer A is 1.00.
**The halftone quality is shown using values of 1 to 10, wherein the value 1 designates an extremely bad halftone and the value 10 designates a very excellent halftone. The halftone quality obtained by developing using a common Metol-hydroquinone developer (e.g., Kodak D-72) is evaluated as 1. A halftone quality above 8 is practical.
***Time necessary to obtain the same sensitivity as that obtained by developing for 90 seconds with Developer A.

Still more, the same treatment was carried out after allowing these developers to stand for 60 hours to evaluate the effects of deterioration by oxidation with air. The results obtained are shown in the following table.

| Developer | Additive | | Development for 90 Second: Relative Sensitivity* | Halftone Quality |
|---|---|---|---|---|
| A | — | — | 0.51 | 3 |
| B | Compound 3 | — | 0.63 | 7 |
| C | — | Diethanolamine | 0.38 | 5 |
| D | Compound 3 | Diethanolamine | 1.00 | 10 |
| E | Compound 13 | — | 1.20 | 2 |
| F | Compound 13 | Diethanolamine | 1.10 | 3 |

*The relative sensitivity is shown as the relative value of the logarithm of the sensitivity assuming that the sensitivity obtained by developing for 90 seconds using Developer A before deterioration due to the lapse of time was 1.00.

The following faults exist with Developers A, B, C, E and F which are outside the scope of this invention. In Developer A, the lowering of the sensitivity and the deterioration of the halftone quality are very large with the lapse of time. In Developer B, the developing period is shortened and the sensitivity is higher than that of Developer A when developed for the same period of time. Further, the halftone quality is good. However, in Developer B, the sensitivity and deterioration of the halftone quality with the lapse of time is markedly lowered. In Developer C, the lowering of the sensitivity with the lapse of time was hardly observed, but the developer before degradation with the lapse of time caused a marked lowering of the sensitivity and a remarkable deterioration of the halftone quality. The halftone quality which is not, of course, improved by well-known quaternary ammonium salt solely can not be improved even if the quaternary ammonium salt is used together with diethanolamine. However, in Developer D according to the present invention, the relative sensitivity is high, the halftone quality is good, and the developing speed is high. Further, lowering of the sensitivity and deterioration of the halftone quality are hardly observed. Accordingly, an excellent litho-type developer can be produced only by using Developer D.

EXAMPLE 2

The same high contrast photographic materials as described in Example 1 were exposed to an exposure wedge for sensitometry through a 150 line magenta contact screen and developed at 27° C using the following four developers.

Developer G

| | |
|---|---|
| Solution I: | |
| Distilled Water | 100 ml |
| Formaldehyde-Sodium Hydrogen Sulfite Addition Product | 32 g |
| Sodium Sulfite | 25 g |
| Triethyleneglycol | 40 g |
| Hydroquinone | 10 g |
| Distilled water to make | 167 ml |
| Solution II: | |
| Distilled Water | 70 ml |
| Formaldehyde-Potassium Hydrogen Sulfite Addition Product | 16 g |
| Boric Acid | 2.5 g |
| Potassium Bromide | 1.0 g |
| Diethanolamine | 40 g |
| Potassium Carbonate | 10 g |
| Distilled water to make | 167 ml |

Just before using, Solution I was added to 600ml of water and then Solution II was added thereto. Additional water was added thereto to make 1 liter.

Developer H

100mg of Compound 2 of the present invention was added to Solution I of Developer G.

Developer I

200mg of Compound 5 of the present invention was added to Solution I of Developer G.

Developer J

200mg of Compound 9 of the present invention was added to Solution I of Developer G.

Development was carried out for 60 seconds, 75 seconds, 90 seconds and 105 seconds. Results obtained are shown in the following table.

| Developer | Additive Compound No. | Additive Amount (mg/l) | Relative Sensitivity* 60 sec | 75 sec | 90 sec | 105 sec |
|---|---|---|---|---|---|---|
| G | — | — | 0.25 | 0.40 | 0.70 | 0.85 |
| H | 2 | 100 | 0.40 | 0.60 | 1.00 | 1.20 |
| I | 5 | 200 | 0.35 | 0.55 | 0.95 | 1.10 |
| J | 9 | 200 | 0.35 | 0.60 | 0.95 | 1.15 |

*The relative sensitivity is shown as the relative value of the logarithm of the sensitivity assuming that the sensitivity obtained by developing for 90 seconds using Developer F is 1.00.

Developer, H, I and J which contain the compound of the present invention show high sensitivity at development.

EXAMPLE 3

The same high contrast photographic materials as described in Example 1 were exposed to an exposure wedge for sensitometry through a 150-line magenta contact screen and developed at 27° C with using following three developers.

Developer K

| | |
|---|---|
| Solution I: | |
| Distilled Water | 100 ml |
| Formaldehyde-Sodium Hydrogen Sulfite Addition Product | 32 g |
| Potassium Sulfite (monohydrate) | 3.5 g |
| Triethyleneglycol | 40 g |
| Hydroquinone | 16 g |
| Distilled water to make | 167 ml |
| Solution II: | |
| Distilled Water | 70 ml |
| Formaldehyde-Sodium Hydrogen Sulfite Addition Product | 14 g |
| Boric Acid | 2.5 g |
| Sodium Bromide | 1.0 g |
| Triethanolamine | 40 g |
| Potassium Carbonate | 20 g |
| Distilled water to make | 167 ml |

Just before using, Solution I was added to 600ml of water and then Solution II was added thereto. Additional water was added to make 1 liter.

Developer L 30g of potassium carbonate was added instead of 40g of triethanolamine in Solution II of Developer K.

Developer M

150mg of Compound 3 of the present invention was added to Solution I of Developer K.

The pH of the developer solutions produced from Developers L and M was adjusted to that of Developer K.

The relative sensitivity and the halftone quality of these three samples are shown in the following table. Further, these developers were allowed to stand for 60 hours for deterioration by air oxidation, and then the same development procedure was carried out. The results obtained are also shown in the following table.

| Developer | Triethanolamine | Compound 3 | Fresh Solution Relative Sensitivity* | Fresh Solution Halftone Quality | Deteriorated Solution Relative Sensitivity* | Deteriorated Solution Halftone Quality |
|---|---|---|---|---|---|---|
| K | present | — | 0.75 | 8 | 0.70 | 7 |
| L | — | — | 1.00 | 9 | 0.50 | 3 |
| M | present | present | 1.20 | 10 | 1.05 | 10 |

The relative sensitivity is shown as the relative value of the logarithm of the sensitivity assuming that the sensitivity obtained by developing for 90 seconds using Developer K is 1.00.

In Developer M of the present invention, the sensitivity is high and the halftone quality is excellent. Further, deterioration of the halftone quality and lowering of the sensitivity are hardly observed when this developer is allowed to stand.

EXAMPLE 4

The same high contrast photographic materials as described in Example 1 were exposed to an exposure wedge for sensitometry through a 150-line magenta contact screen and developed at 27° C with using the following developers.

Developer N

| | |
|---|---|
| Agent I: | |
| Formaldehyde-Sodium Hydrogen Sulfite Addition Product | 70 g |
| Hydroquinone | 16 g |
| Boric Acid | 5 g |
| Potassium Bromide | 3 g |
| Agent II: | |
| Sodium Sulfite | 3 g |
| Sodium Carbonate | 85 g |
| Agent III: | |
| Diethanolamine | 25 g |
| Boric Acid | 2 g |
| Distilled Water to make | 50 ml |

Just before using, Agent I was dissolved in 700ml of water and then Agent II was dissolved therein. Agent III was then added thereto and water was added to make 1 liter.

Developer O

200mg of Compound 1 of the present invention was added to Agent I of Developer N.

The results obtained by developing for 60 seconds, 75 seconds, 90 seconds and 105 seconds are shown in the following table.

| Developer | Additive Compound No. | Additive Amount (mg/l) | Relative Sensitivity 60 sec | 75 sec | 90 sec | 105 sec |
|---|---|---|---|---|---|---|
| N | — | — | 0.25 | 0.40 | 0.60 | 0.85 |
| O | 1 | 200 | 0.45 | 0.60 | 1.00 | 1.20 |

The relative sensitivity is shown as the relative value of the logarithm of the sensitivity assuming that the sensitivity obtained by developing for 90 seconds using Developer is 1.00.

If Developer O of the present invention is used for development, a higher sensitivity can be obtained.

EXAMPLE 5

The same high contrast photographic material as described in Example 1 was exposed to an exposure wedge for sensitometry and developed at 27° C using Developer P having the following composition.

Developer P

| | |
|---|---|
| Solution I: | |
| Distilled Water | 100 ml |
| Formaldehyde-Sodium Hydrogen Sulfite Addition Product | 32 g |
| Sodium Sulfite | 3 g |
| Triethyleneglycol | 40 g |
| Hydroquinone | 18 g |
| Compound 10 | 100 mg |
| Distilled water to make | 167 ml |
| Solution II: | |
| Distilled Water | 70 ml |
| Formaldehyde-Sodium Hydrogen Sulfite Addition Product | 14 g |
| Boric Acid | 2.5 g |
| Potassium Bromide | 2.0 g |
| Diethanolamine | 40 g |
| Triethanolamine | 40 g |
| Potassium Carbonate | 5 g |
| Distilled water to make | 167 ml |

Just before using, Solution I was added to 600ml of water and then Solution II was added thereto. Then water was added to make 1 liter. Developer P had a high developing speed and provided halftone images having good quality. Further, no lowering of the sensitivity and deterioration of the halftone quality with the lapse of time was observed.

While the invention has been described in detail and with reference to specific embodiments thereof, it will be apparent to one skilled in the art that various changes and modifications can be made therein without departing from the spirit and scope thereof.

What is claimed is:

1. A photographic developer composition for obtaining high contrast images which comprises (1) a p-dihydroxybenzene developing agent, (2) an alkanolamine which has the general formula

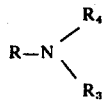

wherein R is a hydroxyalkyl group having 1 to 5 carbon atoms and $R_3$ and $R_4$ are each a hydrogen atom, an alkyl group having 1 to 4 carbon atoms or a hydroxyalkyl group having 1 to 3 carbon atoms, (3) a compound having the following formula (I)

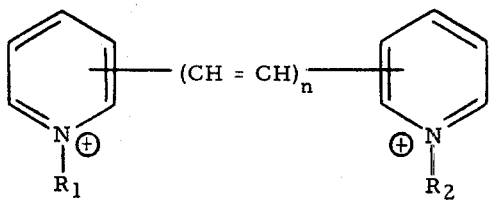

(I)

wherein $R_3$ and $R_4$ each represents an alkyl group having from 1 to 5 carbon atoms, and wherein $R_1$ and $R_2$ may combine to form a 6-, 7- or 8-membered ring which may form an alkylene group or a vinylene group or which may further contain a benzene nucleus fused thereto, *n* represents 0 or 1, and $X^-$ represents an anion, and (4) sulfite in amounts of not more than 5g/l.

2. The photographic developer composition of claim 1, wherein said compound having the formula (I) is

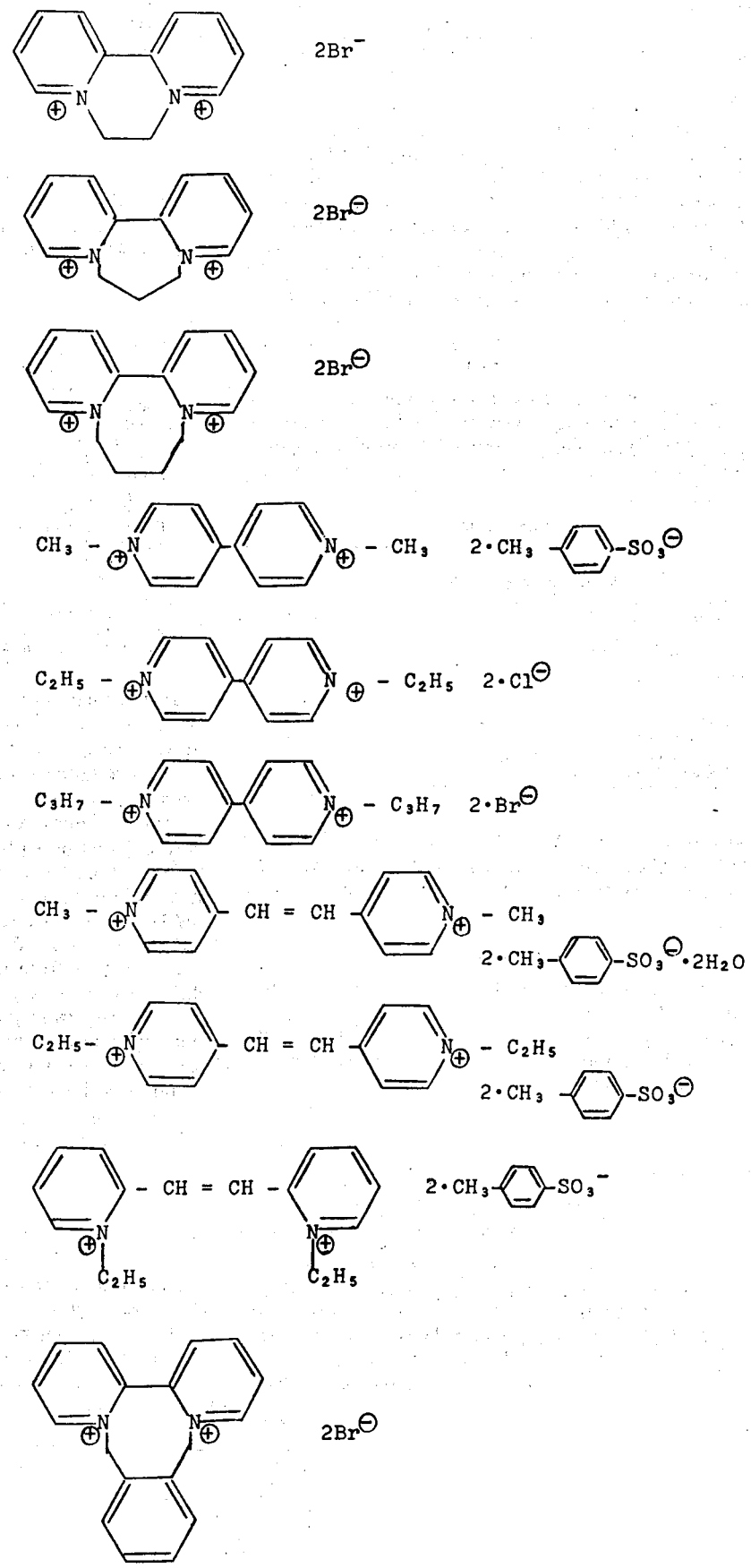

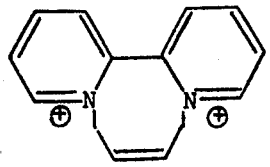

$2Br^{\ominus}$

3. The photographic developer composition of claim 1, wherein said dihydroxybenzene developing agent is a hydroquinone developing agent.

4. The photographic developer composition of claim 3, wherein said hydroquinone developing agent is hydroquinone, chlorohydroquinone, bromohydroquinone, isopropylhydroquinone, toluhydroquinone, methylhydroquinone, 2,3-dichlorohydroquinone or 2,5-dimethylhydroquinone.

5. The photographic developer composition of claim 4, wherein said hydroquinone developing agent is hydroquinone.

6. The photographic developer composition of claim 1, wherein said alkanolamine is tertiary alkanolamine or a secondary alkanolamine.

7. The photographic developer composition of claim 6, wherein said alkanolamine is diethanolamine, diisopropylamine, triethanolamine or triisopropanolamine.

8. The photographic developer composition of claim 1, wherein said dihydroxybenzene developing agent, said alkanolamine and said compound having the formula (I) are present in said composition so as to provide from 5 to 50 grams per liter of a developer prepared therefrom for said dihydroxybenzene developing agent, 5 to 400 grams per liter of a developer solution prepared therefrom for said alkanolamine and from $1 \times 10^{-5}$ to $1 \times 10^{-2}$ mols per liter of a developer solution prepared therefrom for said compound having the formula (I).

9. The photographic developer composition of claim 1, wherein said developer composition contains at least one of a sulfite ion buffer, an alkali metal sulfite salt, an alkali and a pH buffer.

10. The photographic developer composition of claim 9, wherein said developer composition contains at least 1 of an antioxidant, an antifogging agent, and a water softener.

11. A method for the development of imagewise exposed high contrast photographic materials having a silver halide layer containing not less than 50 mol% silver chloride comprising developing said photographic materials in the photographic developer composition of claim 1.

12. The method for development of claim 11, wherein said compound having the formula (I) is

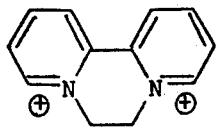

$2Br^{-}$

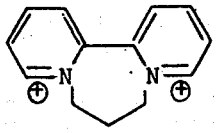

$2Br^{\ominus}$

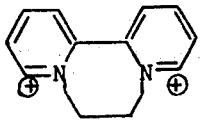

$2Br^{\ominus}$

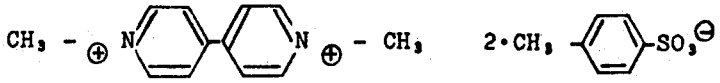

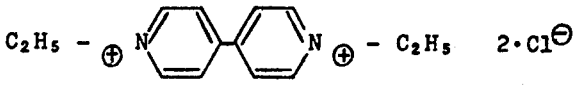

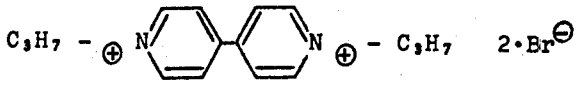

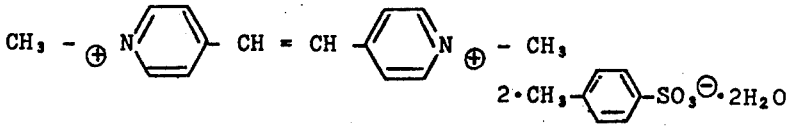

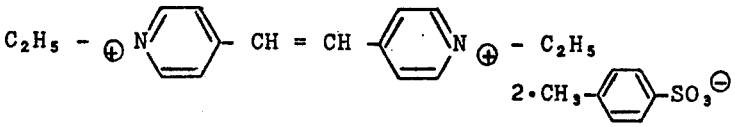

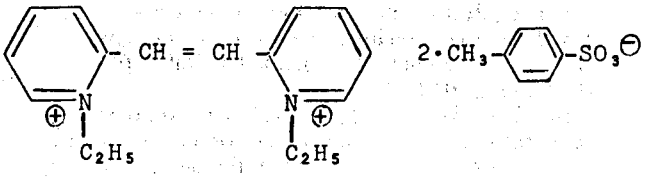

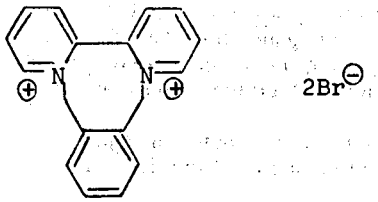

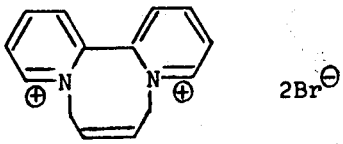

13. The method of development of claim 11, wherein said dihydroxybenzene developing agent is a hydroquinone developing agent.

14. The method of development of claim 13, wherein said hydroquinone developing agent is hydroquinone, chlorohydroquinone, bromohydroquinone, isopropylhydroquinone, toluhydroquinone, methylhydroquinone, 2,3-dichlorohydroquinone or 2,5-dimethylhydroquinone.

15. The method of development of claim 14, wherein said hydroquinone developing agent is hydroquinone.

16. The method of development of claim 11, wherein said alkanolamine is a tertiary alkanolamine or a secondary alkanolamine.

17. The method of development of claim 16, wherein said alkanolamine is diethanolamine, diisopropylamine, triethanolamine or triisopropanolamine.

18. The method of development of claim 11, wherein said dihydroxybenzene developing agent, said alkanolamine and said compound having the formula (I) are present in said composition so as to provide from 5 to 50 grams per liter of a developer solution prepared therefrom for said dihydroxybenzene developing agent, 5 to 400 grams per liter of a developer solution prepared therefrom for said alkanolamine and from $1 \times 10^{-5}$ to $1 \times 10^{-2}$ mols per liter of a developer solution prepared therefrom for said compound having the formula (I).

19. The method of development of claim 11, wherein said developer composition contains at least one of a sulfite ion buffer, an alkali metal sulfite salt, an alkali and a pH buffer.

20. The method of development of claim 19, wherein said developer composition contains at least one of an antioxidant, an antifogging agent, and a water softener.

* * * * *